US006185781B1

(12) United States Patent
Miller et al.

(10) Patent No.: US 6,185,781 B1
(45) Date of Patent: Feb. 13, 2001

(54) HAND SCRUB TOOL WITH INTERCHANGEABLE SCRUB DRIVES

(75) Inventors: Daniel R. Miller; Robert W. Bauman, both of North Canton; Donald A. Coates, Canton; Arne J. Diehl, North Canton; John D. Essex, North Canton; Adam C. Sclafani, North Canton, all of OH (US)

(73) Assignee: The Hoover Company, North Canton, OH (US)

( * ) Notice: Under 35 U.S.C. 154(b), the term of this patent shall be extended for 0 days.

(21) Appl. No.: 09/339,784

(22) Filed: Jun. 24, 1999

(51) Int. Cl.[7] ..... A47L 9/04; A47L 11/36

(52) U.S. Cl. ..... 15/322; 15/28; 15/97.1; 15/328; 15/344; 15/387

(58) Field of Search ..... 15/97.1, 28, 29, 15/322, 328, 344, 364, 387

(56) References Cited

U.S. PATENT DOCUMENTS

| | | | | |
|---|---|---|---|---|
| 1,588,943 | | 6/1926 | Clark | 15/98 |
| 1,697,918 | | 1/1929 | Keefer | 15/328 |
| 1,872,602 | | 8/1932 | Olsen | 15/50.1 |
| 1,891,175 | | 12/1932 | Petersen | 15/328 |
| 2,516,246 | | 7/1950 | Norris | 15/369 |
| 2,744,272 | * | 5/1956 | Theis et al. | 15/387 |
| 2,967,314 | * | 1/1961 | Kowalewski | 15/28 |
| 4,158,246 | * | 6/1979 | Meadows et al. | 15/28 |
| 4,168,560 | * | 9/1979 | Doyel | 15/29 |
| 4,458,676 | * | 7/1984 | Pileggi | 15/97.1 |
| 4,557,013 | | 12/1985 | Belmont | 15/401 |
| 4,817,233 | | 4/1989 | Waldhauser | 15/320 |
| 4,879,784 | | 11/1989 | Shero | 15/322 |
| 4,885,815 | * | 12/1989 | Smith | 15/28 |
| 5,056,186 | * | 10/1991 | Jiam-Fa | 15/328 |
| 5,493,752 | * | 2/1996 | Crouser et al. | 15/322 |
| 5,497,530 | | 3/1996 | Kamm et al. | 15/321 |
| 5,499,424 | | 3/1996 | Lau | 15/322 |
| 5,687,442 | | 11/1997 | McClain | 15/29 |
| 5,867,864 | * | 2/1999 | Miller et al. | 15/322 |
| 5,870,798 | * | 2/1999 | Crouser et al. | 15/322 |

FOREIGN PATENT DOCUMENTS

| | | |
|---|---|---|
| 584806 | 10/1959 | (CA) . |
| 3113645 | 8/1982 | (DE) . |
| 597949 | 8/1995 | (EP) . |
| 2078496 | 1/1982 | (GB) . |

OTHER PUBLICATIONS

Dirt Devil Owner Manuel (Scrub Devil) Copyright Royal Appliance Mfg. Co. 1997.
Black & Decker Owners Manual (ScumBuster) Copyright 1996.

* cited by examiner

*Primary Examiner*—Robert J. Warden, Sr.
*Assistant Examiner*—Theresa T. Snider
(74) *Attorney, Agent, or Firm*—A. Burgess Lowe; Bruce P. Watson

(57) ABSTRACT

A compact, hand held carpet and upholstery extractor nozzle is provided having an air turbine and a compact gear reduction operatively connected to and driven by said turbine. At least a pair of scrub modules are interchangeably attachable to said gear reduction. A first scrub modules includes at least a pair of vertical axis scrub brushes for cleaning upholstery, carpeting and the like. When said first scrub module is attached to said gear reduction, the scrub brushes are operatively connected to and driven by said gear reduction. A second scrub module includes a single vertical axis scrub pad that is driven by said gear reduction for scouring hard surfaces, such as tiles, tubs, counter tops, etc.

24 Claims, 9 Drawing Sheets

HAND SCRUB TOOL WITH INTERCHANGEABLE SCRUB DRIVES

BACKGROUND OF THE INVENTION

1. Field of the Invention

This invention pertains to a hand held, wet pickup, powered scrubbing tool having at least two interchangeable scrubbing elements. More particularly, this invention pertains to a compact hand held extractor nozzle having at least two interchangeable powered scrubbing modules, namely, at least a brush module including a pair of vertical axis scrub brushes and a scrub pad module including a single vertical axis scrub pad.

2. Description of the Prior Art

It is known in the prior art to provide hand held extractor nozzles and scrubbers with powered agitators, such as a scrub pad or a brush. Powered hand tools having a single axis scrubbing element, such as a scrub pad or a scrub brush, for cleaning hard surfaces are common in the prior art, as illustrated by U.S. Pat. Nos. 2,967,314 and 5,687,442. U.S. Pat. No. 5,587,442 discloses a water powered, hard surface scrubber having a single vertical axis scrub brush that may be interchanged with a single vertical axis scrub pad.

Scrubbing tools that a have a pair of vertical axis scrub brushes are also common in the art. U.S. Pat. No. 2,220,224 discloses a hard floor scrubber having a pair of vertical axis scrub brushes. An extractor hand tool with a pair of turbine powered vertical axis scrub brushes for cleaning upholstery is disclosed in commonly owned U.S. Pat. No. 5,867,864.

When cleaning carpet or upholstery, it is desirable to use a scrub brush with relatively soft bristles rather than a relatively stiff and abrasive scrub pad. Scrub pads tend to be too abrasive for scrubbing upholstery and are likely to damage the fabric. Whereas, the bristles on a relatively soft scrub brush gently scrub the detergent into the upholstery and loosen embedded soil without damaging the fabric. A pair of vertical axis scrub brushes tends to clean carpet or upholstery more effectively than a single vertical axis or horizontal axis scrub brush. Hard surfaces, on the other hand, are more effectively cleaned with a more aggressive and abrasive scrub pad. There is a need in the art for a powered hand tool that is capable of effectively cleaning both hard surfaces using a scrub pad and carpet or upholstery with a scrub brush.

SUMMARY OF THE INVENTION

An objective of the present invention is to provide a compact hand held, wet extraction suction nozzle having powered scrub brushes.

Another objective of the present invention is to provide a compact hand held suction nozzle having a powered scrub pad.

A further objective of the present invention is to provide a powered hand tool for an extraction type cleaning machine having interchangeable brush and scrub pad scrubbing modules.

A further objective of the present invention is to provide a powered hand tool for an extraction type cleaning machine having a dual or multiple axis scrub brush module that is interchangeable with a single vertical axis scrub pad modules.

A further object of the invention is to provide a compact hand held extractor nozzle having an air turbine powered scrubbing tool.

A further object of the present invention is to provide a hand held extractor nozzle having powered scrub brushes and/or powered scrub pad that are driven by non-electrical means, in order to eliminate the danger of electrical shock when using the nozzle for wet pickup.

The foregoing and other objects of the present invention, that will be readily apparent upon reviewing the following description of a preferred embodiment and the attached drawings, are achieved in a preferred embodiment of the present invention by providing an extractor nozzle having air turbine powered scrub brushes. The turbine has at least one ambient air inlet and an outlet that communicates with a suction tube extending from the extractor or wet pickup suction nozzle. The turbine drives a pair of vertical axis rotary scrub brushes or a single vertical axis scrub pad located adjacent to the extractor nozzle. A compact gear reduction operatively connects the air turbine to the scrub brushes or to the scrub pad. The nozzle is preferably provided with a trigger actuated spray head for selectively applying cleaning liquid to a surface to be cleaned.

In one form of the present invention, an extractor nozzle is provided having an air turbine powered agitator, in which the turbine has at least one ambient air inlet and an outlet that communicates with a suction tube that is fluidly connected to the extractor or wet pickup suction nozzle.

BRIEF DESCRIPTION OF THE DRAWINGS

The invention will now be described, by way of example, with reference to the attached drawings, of which.

DETAILED DESCRIPTION OF A PREFERRED EMBODIMENT

Figure 1:
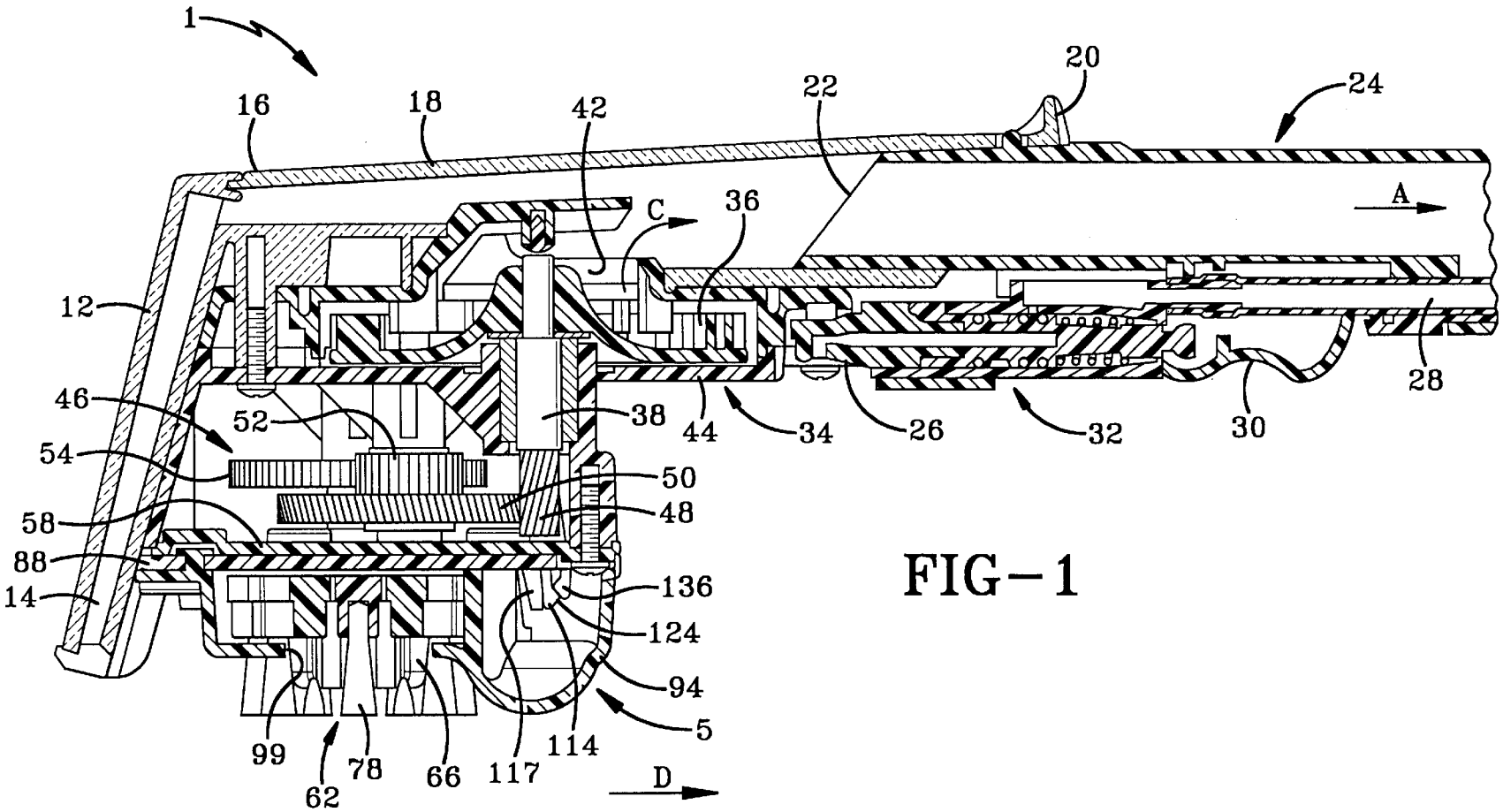
FIG. 1 is a longitudinal cross section of a turbine powered, wet extraction suction nozzle having a dual vertical axis upholstery scrub brush module according the present invention attached thereto.

A longitudinal, vertical cross-section of a wet extraction type powered hand tool 1 (hereinafter "extractor nozzle") having a scrub brush module 5, according to one form or preferred embodiment of the present invention, attached thereto is illustrated in FIG. 1. The extractor nozzle includes a wet pickup suction nozzle 12 having a narrow, elongate nozzle inlet 14 for extracting liquid from a hard surface, carpet or other surface to be dried or cleaned. The suction nozzle is in fluid communication with a first end 16 of a suction tube 18. A second end 20 of the suction tube is shown mounted to an outer end 22 of a hand held suction and spray wand 24.

The hand held spray and suction wand 24 includes a cleaning liquid applicator, preferably a spray nozzle 26, that is preferably connected to a cleaning liquid supply pump (not shown) of a carpet extractor (not shown) by a flexible supply tube 28. A trigger 30 operated valve 32 communicates the spray nozzle with the liquid supply tube for selectively spraying cleaning liquid out the spray nozzle onto a surface to be cleaned. The wand 24 provides a hand grip that the operator may grasp with one hand for convenient above floor cleaning. A more detailed description of the spray and suction wand can be found in commonly owned U.S. Pat. No. 5,870,798, the description of which is hereby incorporated herein as of reference.

A flexible suction hose (not shown) connects the opposite end of the wand 24 to an extractor or other wet pickup suction cleaner (not shown), for example, an upright style carpet extractor as disclosed in commonly owned U.S. Pat. No. 5,493,752 entitled Upright Carpet and Upholstery Extractor. The extractor nozzle 1 is releasably retained on the end of the hand held wand 24 in a well known, conventional manner.

The extractor nozzle includes a turbine 34 for powering the scrub brush module. The turbine includes a generally disc shaped turbine rotor 36 rotatably mounted in a turbine housing on an axle 38. A plurality of turbine inlet openings 40 (see FIG. 7) pass through the peripheral wall of the turbine housing and a turbine outlet opening 42 passes through a center of an upper wall of turbine housing. The turbine outlet opening communicates with the interior of the suction tube 18 via an opening passing through a lower side of the suction tube.

When suction is applied to the suction tube 18, as indicated by arrow A, ambient air is drawn in through the turbine inlet openings 40, through the turbine rotor 36 and out through the turbine outlet opening 42, as indicated by arrow C, thereby driving the turbine rotor. Air is also simultaneously drawn in through the suction nozzle 12 for extracting soiled cleaning liquid from a surface being cleaned. Screens (not shown) are preferably mounted in the turbine inlet openings 40 to prevent dust, lint and other debris from being drawn in the inlet openings and fouling the turbine. The suction nozzle 12 and the suction tube 18 are preferably formed out of a transparent plastic material, so that the operator may visually observe the flow of soiled cleaning liquid and debris in the suction nozzle and the suction tube.

Figure 7:
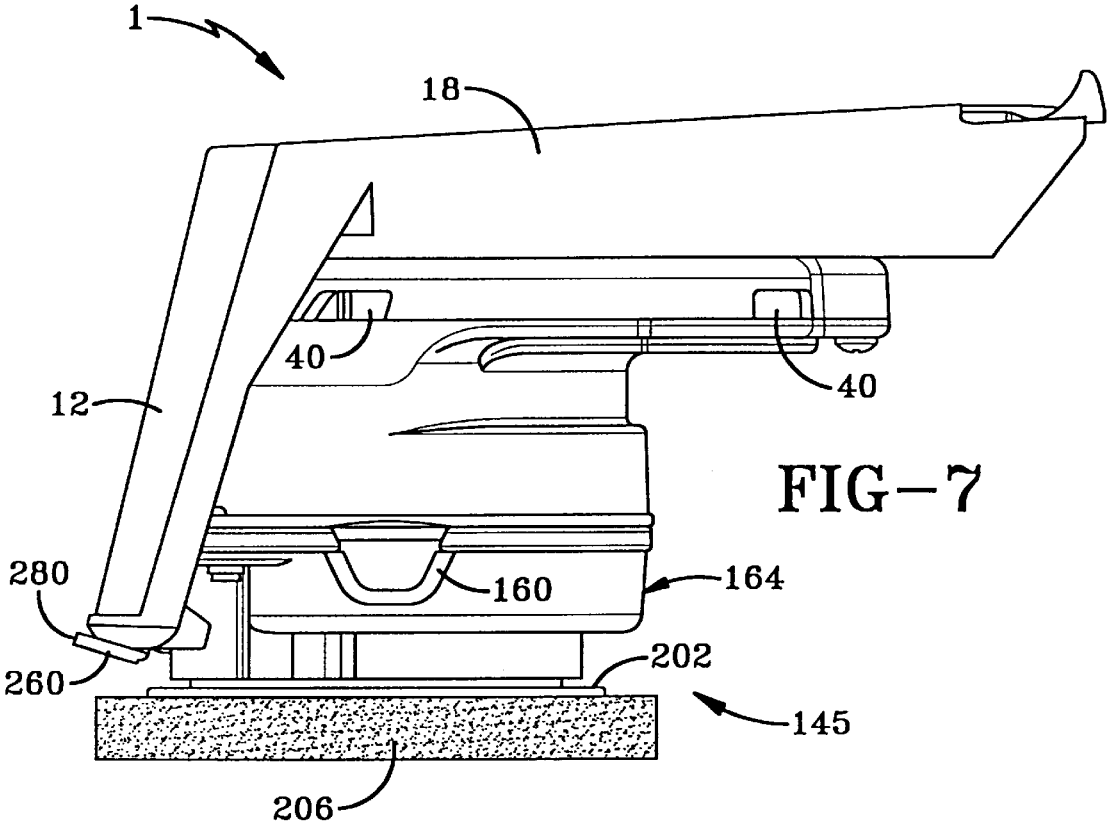
FIG. 7 is a side view of the suction nozzle with a scrub pad module according the present invention attached thereto.

The terms up, down, upper and lower are used in relation to the extractor nozzle 1 and scrub brush module 5 when oriented as illustrated in FIGS. 1 and 7, with upper meaning toward the suction tube 18 and lower meaning toward the nozzle inlet 14. Likewise, the terms front and forward means toward the suction nozzle end of the extractor nozzle and the terms back and rearward means toward the wand attachment end of the extractor nozzle. It can be appreciated that the orientation ofthe extractor nozzle 1 changes during use. As such, the terms up, down, upper, lower, front, back, forward and rearward, etc., as used in the description and the appended claims, are only intended to describe the parts of the nozzle when the nozzle is in the orientation illustrated in FIGS. 1 and 7, with the scrub module and nozzle inlet 4 facing down.

The turbine axle 38 extends through a lower wall 44 of the turbine housing and drives the scrub brush module via a gear train 46 in a gear housing. The portion of the turbine axle 38 outside the turbine housing preferably has helical gear teeth formed integrally therewith forming a gear shaft 48. The gear shaft engages helical gear teeth on an outer periphery of an idler or reducing gear 50, such that the idler gear is driven by the turbine rotor 36. A reduced diameter portion 52 of the idler gear engages and drives a spur gear 54. A drive shaft 56 (see FIGS. 5 and 6) is integrally formed with the spur gear. The drive shaft is noncircular in cross-section, preferably pentagonal, and extends beyond a lower wall 58 of the gear housing for driving the scrub module.

The diameters of the idler and spur gears are preferably selected to achieve a gear reduction ratio of about 20 to 1 from the turbine rotor 36 to the scrub brush module. It can be appreciated that the optimum gear reduction ratio will vary depending upon the desired speed and power of the brushes and the amount of suction and air flow available for driving the turbine. The turbine extractor nozzle is described in further detail in co-owned U.S. Pat. No. 5,867,864, the disclosure of which is hereby incorporated herein as of reference.

Figure 2:
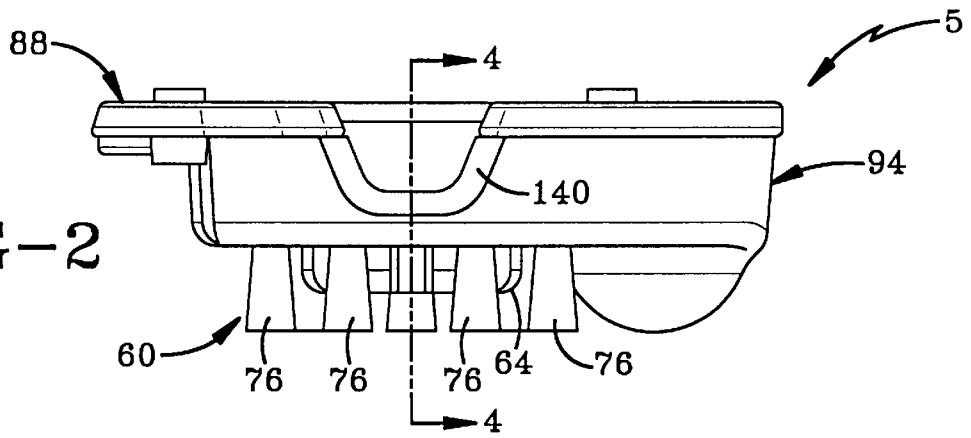
FIG. 2 is a side view of the scrub brush module detached from the suction nozzle.
Figure 4:
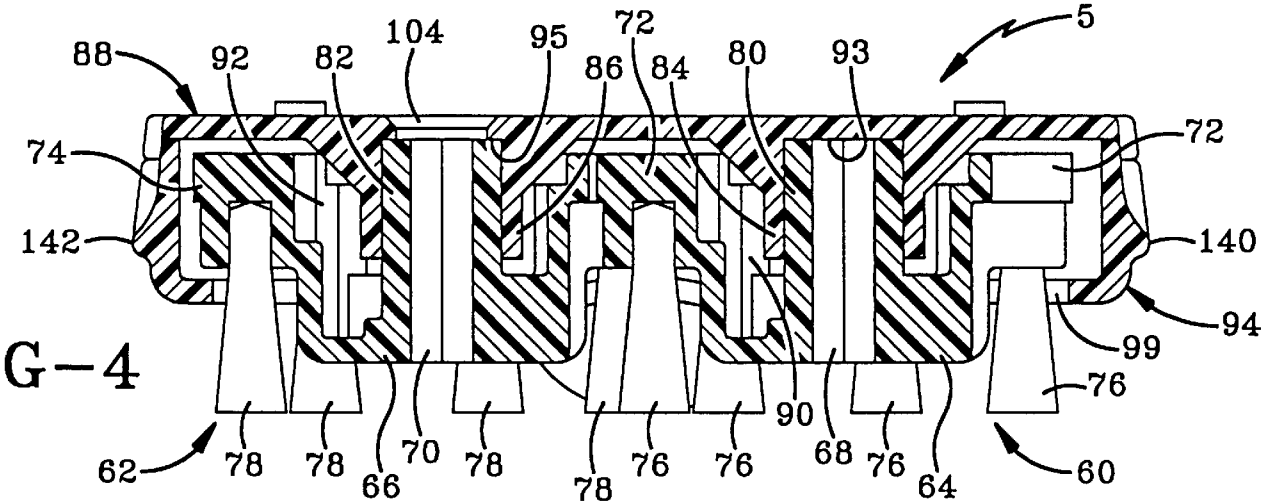
FIG. 4 is a cross-section of the scrub brush module taken along line 4—4 in FIG. 2.
Figure 3:
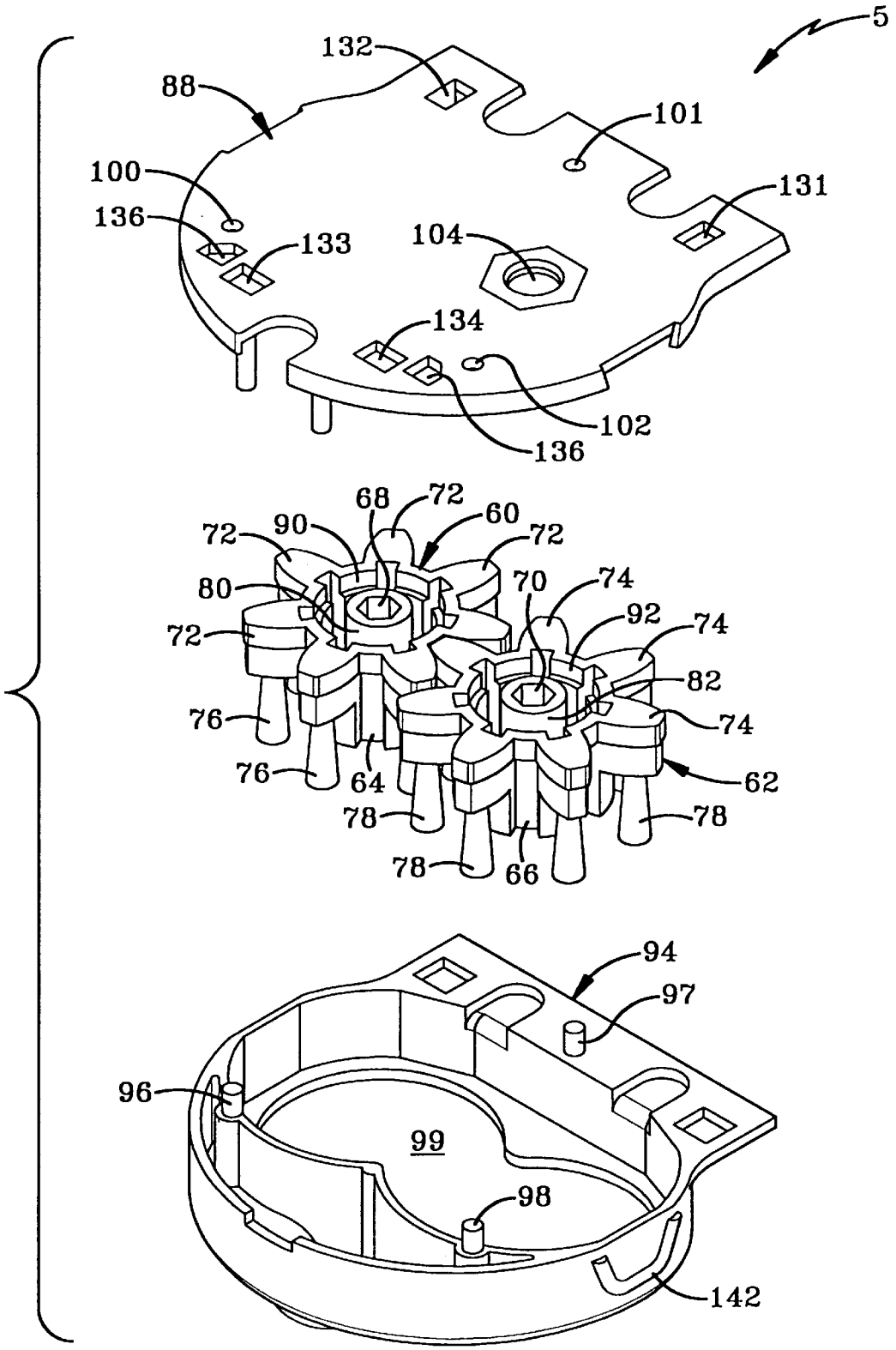
FIG. 3 is an exploded view of the scrub brush module of FIG. 2.

The scrub brush module 5 is detachable from the turbine housing and is illustrated in FIGS. 2 through 4. As best seen in FIGS. 3 and 4, the brush module includes a pair of vertical axis scrub brushes 60 and 62. The brushes include central hubs 64 and 66 having non-circular openings 68 and 70 extending axially through the center of each hub. The central openings are preferably pentagonally or hexoganally shaped and are sized to non-rotatably receive the output shaft 56 from the gear reduction therein. Gear teeth 72, 74 extend out from the outer periphery of the hubs and a group of bristles 76, 78 extend down from each of the gear teeth. The brushes are mounted side by side in the brush module, such that the gear teeth 72, 74 on the brushes intermesh.

As best illustrated in FIG. 4, the brushes 60,62 each have brush mounting stems 80, 82 integrally formed therewith. The brush mounting stems are received in hollow 20 cylindrical brush mounting posts 84, 86 extending down from a top wall 88 of the scrub brush module 5. In order to provide a compact brush assembly, the brushes have annular recesses 90, 92 surrounding the mounting stems 80, 82 for receiving the mounting posts 84, 86 therein. The brushes are axially retained in place on the mounting posts by a brush housing 94. The ends of the mounting stems on the brushes abut against an inner end surface 93, 95 inside the hollow mounting posts 84, 86 and the ends of the gear teeth abut against the rim of a brush opening 99 in the brush housing 94. The groups of bristles on the brushes extend out the brush opening 99 for engaging a surface to be cleaned.

The brush housing 94 is preferably secured to the top wall 88 by inserting a plurality of stakes 96, 97, 98 through a plurality of corresponding holes 100, 101, 102 on the top wall. The tops of the stakes are then softened by heating the tops of the stakes, and the tops of the stakes then deformed (squashed) to essentially rivet the brush housing to the top wall. Although, it will be appreciated that any other suitable means of fastening the brush housing to the top wall may be employed. A through 104 hole is located in the top wall 88 of the brush module 5 and is located concentrically above the opening 70 in one of the brushes 62. When the brush module is attached to the extractor nozzle, the drive shaft 56 passes through the through hole and is non-rotatably received in the central opening 70 in the brush 62 aligned with the through hole.

Figure 5:
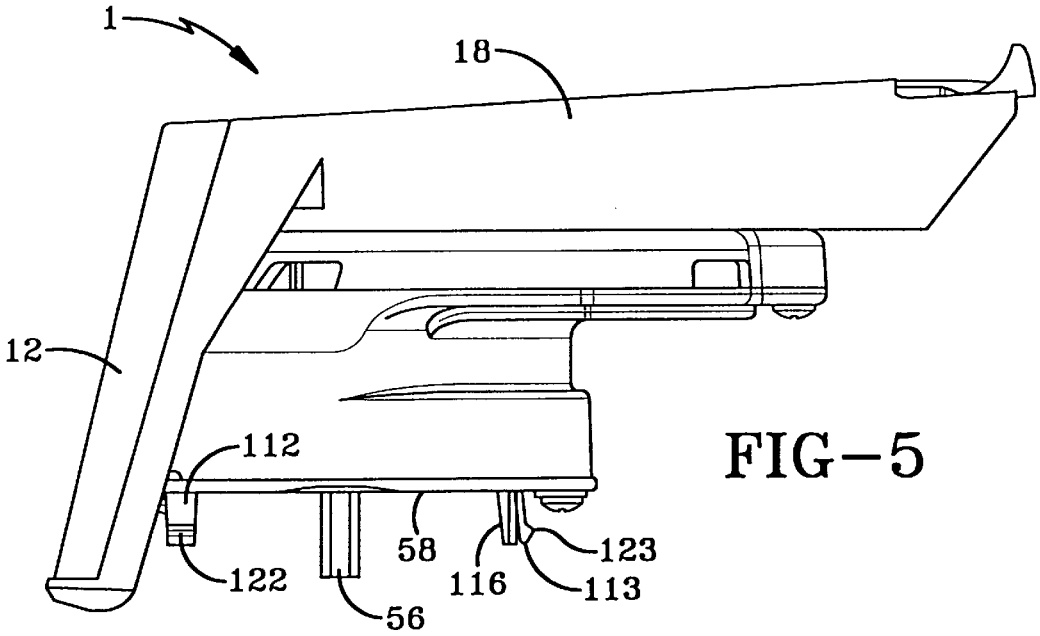
FIG. 5 is a side view of the suction nozzle of FIG. 1, without a scrub module attached thereto.
Figure 6:
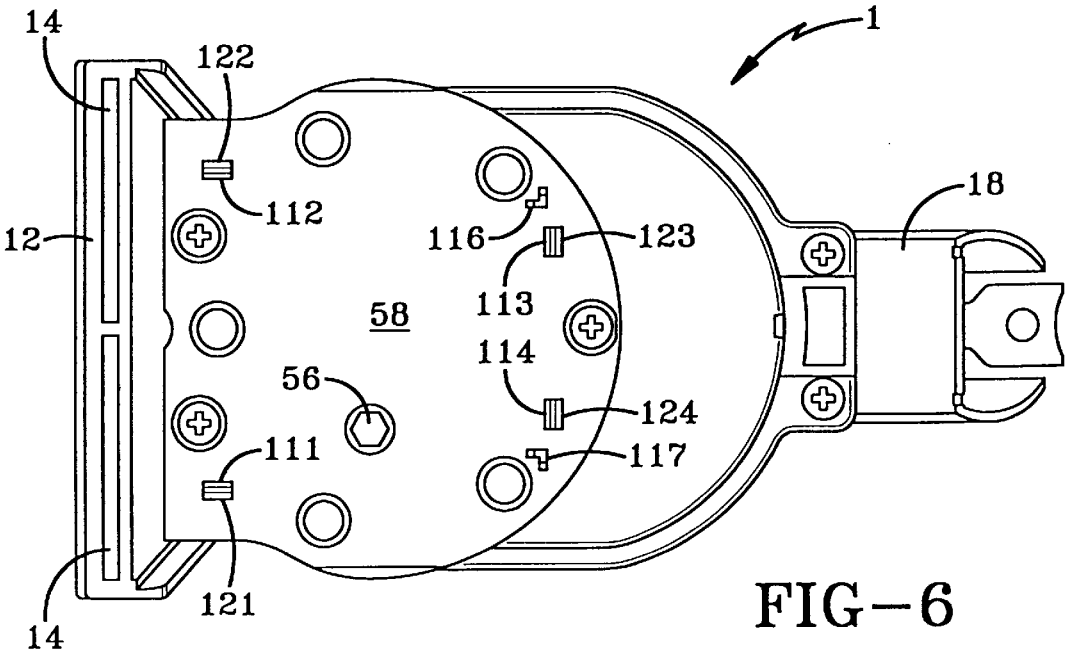
FIG. 6 is a bottom view of the suction nozzle without a scrub module attached thereto.

Referring now to FIGS. 5 and 6, which illustrate the extractor nozzle 1 with the scrub brush module S removed therefrom, four resilient latch arms 111, 112, 113 and 114 and two tapered aligning posts 116, 117 extend down from the lower wall of the gear housing. The aligning posts serve primarily to shield the adjacent latch arms from impact and protect the latch arms from being broken off. The latch arms have barbs 121, 122, 123, 124 on their lower ends. In order to attach the scrub brush module 5 to the extractor nozzle 1, the latch arms and the aligning posts are aligned with corresponding openings 131–134 and 136 in the top wall 88 of the brush module. The brush module and the extractor nozzle are then pressed together, until the top wall of the brush module is flush with the lower wall of the gear housing.

As the two parts are pressed together, the aligning posts 116, 117 and the latch arms 111–114 are received in their corresponding openings 136, 117 and 131–134 in the brush module, and the drive shaft 56 is received through the through hole 104 and in the central opening in the brush 62 that is aligned with the through hole. The barbs 121–124 on the ends of the latch arms resiliently cam over corresponding bosses that are integrally formed with the top wall 88 adjacent to each hole 131–134 in the top wall that receives a latch arm therethrough. Only one of the bosses 139 is visible in FIG. 1. The barbs on the latch arms snap back on the interior of the bosses, such that the barbs releasably retain the brush module 5 on the extractor nozzle I, as illustrated in FIG. 1. The drive shaft 56 is non-rotatably received in the central opening 70 in one of the brushes 62 for rotationally driving the brushes.

To facilitate removal of the scrub bond module from the extractor nozzle, generally U-shaped ribs 140, 142 are located on either side of the brush module. The ribs 140, 142 are sized and shaped to be gripped with the finger tips of fingers of one hand, preferably of the thumb and middle finger, while grasping the extractor nozzle in the other hand. An operator then pulls the scrub brush module 5 away from the extractor nozzle 1 with sufficient force to cam the barbs on the latch arms over the corresponding bosses, and thereby detaches the scrub brush module from the extractor nozzle.

In use, an operator simultaneously presses the suction inlet 14 and the scrub brushes 60, 62 against a surface to be cleaned and then depresses the trigger 30 while pulling the extractor nozzle 1 in a rearward direction as indicated by arrow D in FIG. 1. Upon depressing the trigger, the spray nozzle 26 sprays cleaning liquid onto the carpet or other surface to be cleaned. The brushes 60, 62 distribute the liquid on the carpet or fabric, work the liquid into the carpet or fabric, and loosen embedded or dried on soil with a scrubbing action. By depressing the trigger while moving the nozzle in a rearward direction, the scrub brushes scrub a surface to be cleaned substantially immediately after the cleaning liquid is sprayed onto the surface by the spray nozzle, and the suction nozzle 12 extracts the soiled cleaning liquid from the surface substantially immediately after the surface has been scrubbed by the scrub brushes. In this manner, the cleaning liquid is extracted before it has time to penetrate too deeply into the fabric, carpet, or other surface being cleaned to be sufficiently extracted by the nozzle. However, it can be appreciated that for stubborn spots or stains, the spot may be pre-treated by spraying cleaning liquid from the spray nozzle onto the spot or stain prior to scrubbing the spot with the scrub brushes and extracting the cleaning liquid with the nozzle. Moving the turbine nozzle while spraying also helps prevent over-saturation of the carpet or other surface being cleaned.

Figure 8:
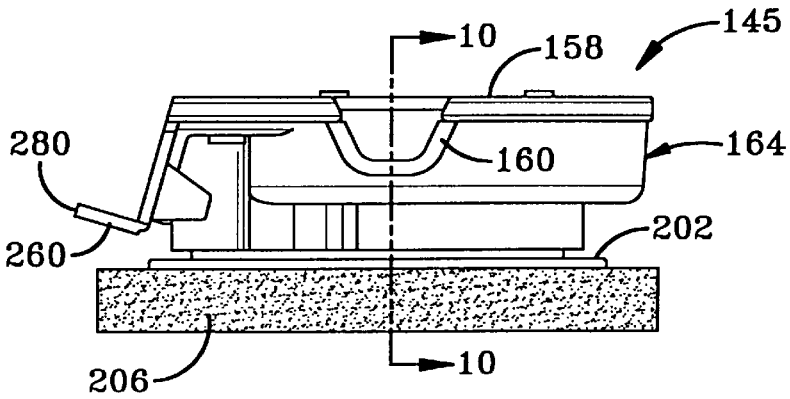
FIG. 8 is a side view of the scrub pad module removed from the suction nozzle.

FIG. 7 illustrates the extractor nozzle 1 with a scrub pad module 145, according to one form or preferred embodiment of the present invention, attached thereto for cleaning hard surfaces, such as showers, tubs, bare floors, etc. The scrub pad module attaches to the extractor nozzle by receiving the latch arms 111–114, and aligning posts 116, 117 extending down from the extractor nozzle 1 in corresponding holes 151–154 and 156, 157 in a top plate 158 of the scrub pad module, in the same manner that the scrub brush module 5 attaches to the extractor module. U-shaped ribs 160, 162 (only one of which 160 is visible in FIG. 7) are provided on either side of the scrub pad module to facilitate removal of the scrub pad module from the extractor nozzle. The scrub pad module is illustrated removed from the extractor nozzle in FIG. 8.

Figure 9:
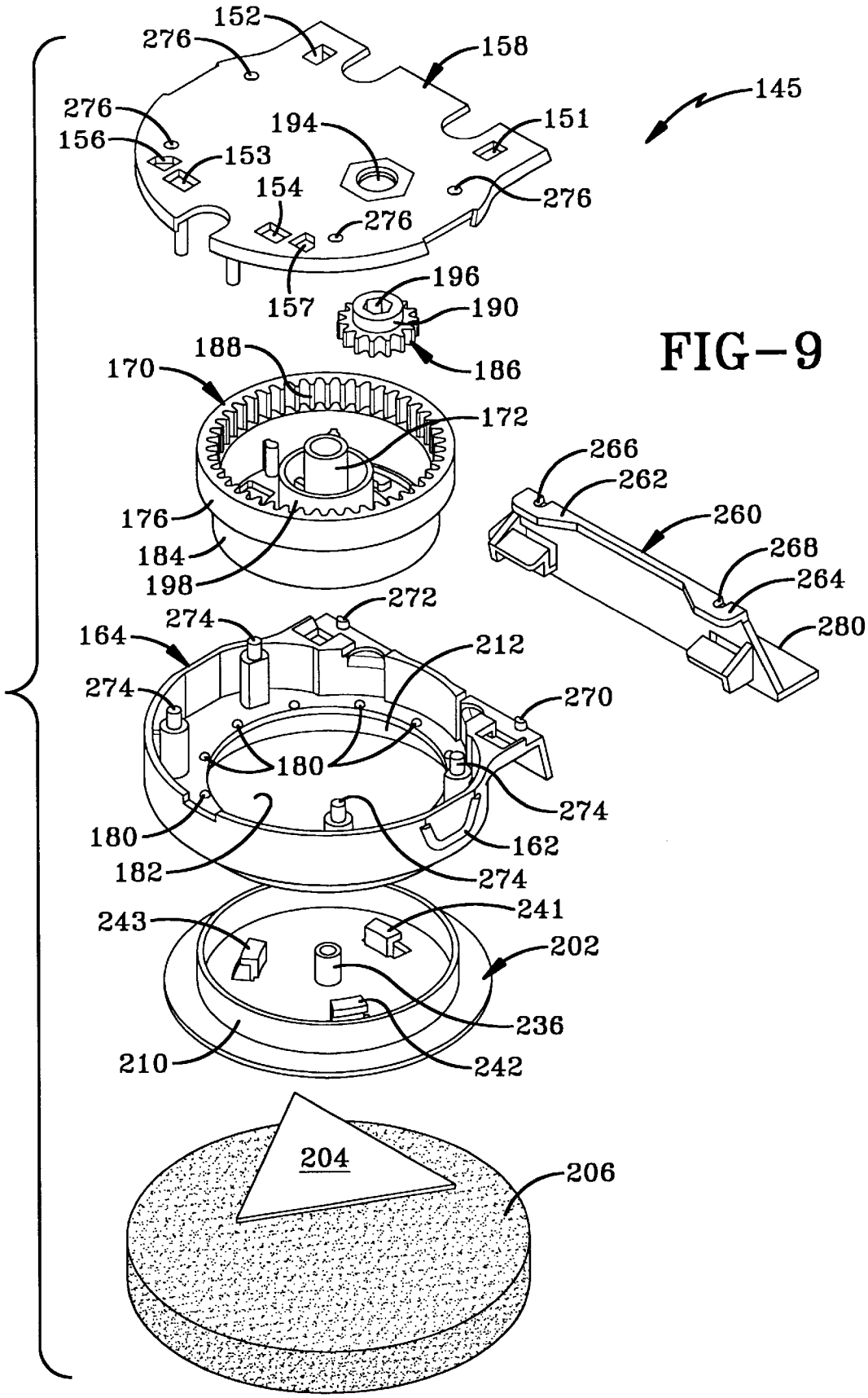
FIG. 9 is an exploded view of the scrub pad module.
Figure 10:
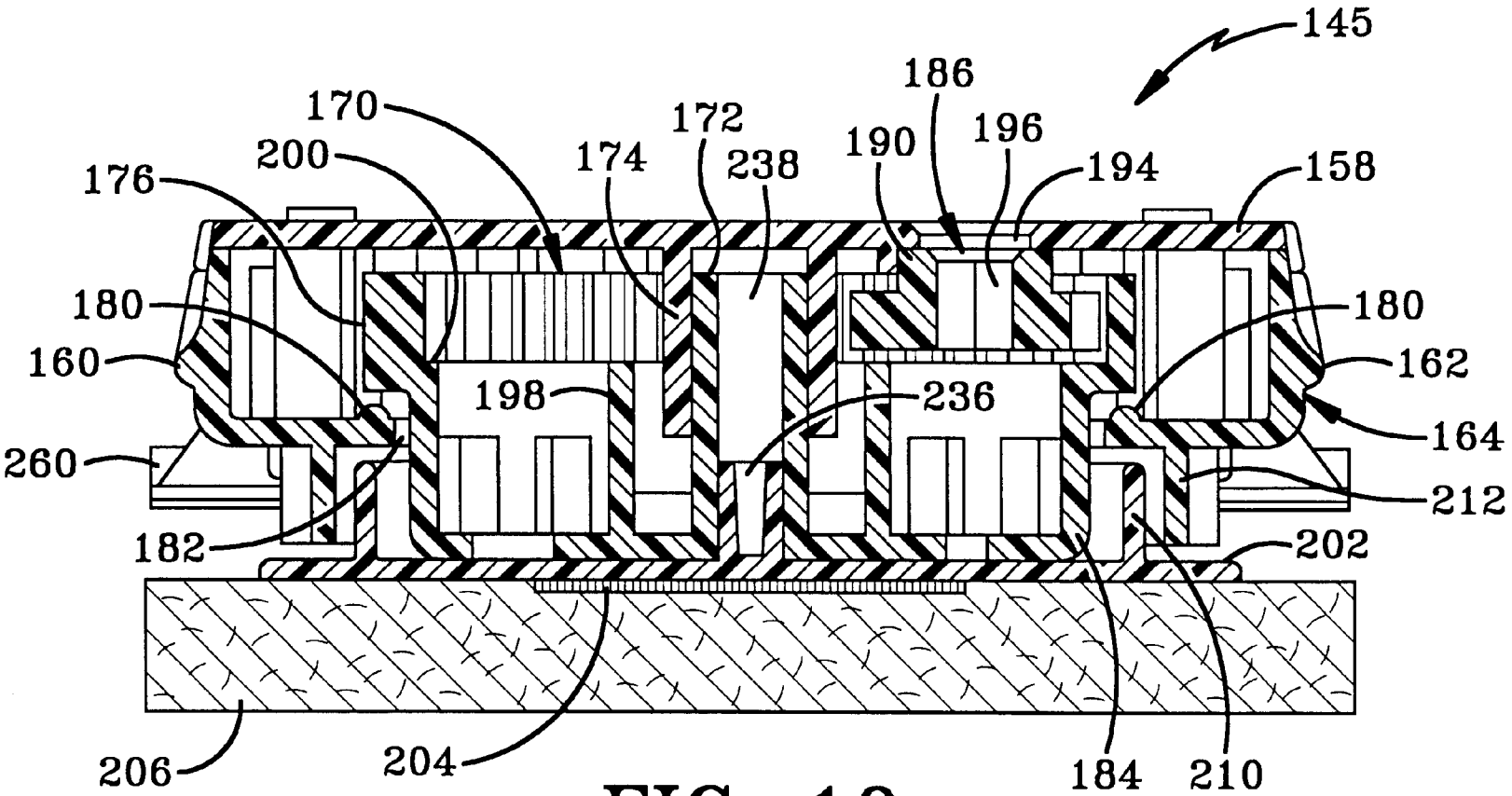
FIG. 10 is a cross section of the scrub pad module taken along line 10—10 in FIG. 8.

As best illustrated in FIGS. 9 and 10, the scrub module 145 includes the top plate 158 and a scrubber drive housing 164. A hub 170 is mounted between the top plate and the scrubber housing. A cylindrical mounting post 172 extends axially up from the center of the drive hub and is received in a cylindrical sleeve 174 extending down from the top plate. A peripheral shoulder 176 on the drive hub is sandwiched between the scrubber housing 164 and the top plate 158. Small nubs 180 are formed on the upper surface of the scrubber housing and are spaced around the periphery of a scrubber opening 182 in the scrubber housing. The nubs 180 engage the shoulder 176 on the hub to reduce the friction created between the upper surface of the scrubber housing and the drive hub. A central drive portion 184 of the hub protrudes through the scrubber opening.

A spur gear 186 is located inside the hub and engages gear teeth 188 formed on an inner peripheral surface of the drive hub 170. A protruding central portion 190 of the spur gear is rotatably received in an annular rib on an inner lower surface of the top wall 158. The annular rib is concentric with a through hole 194 passing through the top plate for axially aligning a non-circular opening 196, in the spur gear with the through hole. The drive shaft 56 extending down from the extractor nozzle 1 extends through the through hole and is non-rotatably received in the opening in the spur gear for driving the spur gear, which in turn drives the hub. The spur gear is axially retained in place by being sandwiched between the top plate 158 and an annular retaining wall 198 extending up from the drive hub and between the top plate and the inner side 200 of the shoulder portion 176 of the hub.

Figure 11:
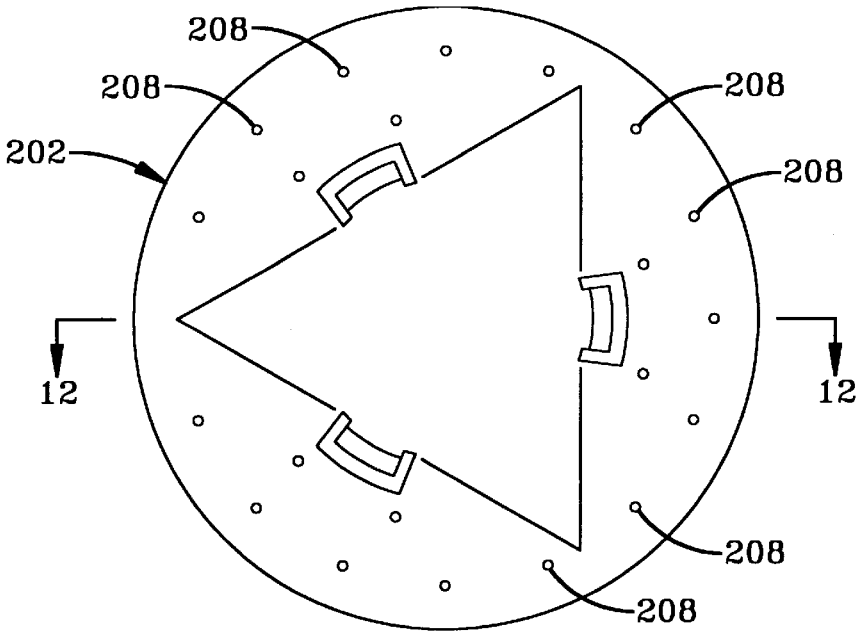
FIG. 11 is a bottom view of the scrub pad plate.
Figure 12:
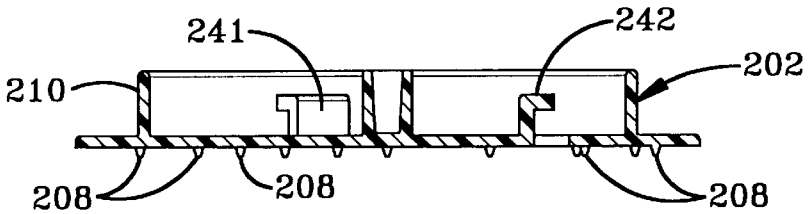
FIG. 12 is a cross-section of the scrub pad plate taken along line 12—12 in FIG. 11.

A scrub pad plate 202 is removably mounted to the protruding drive portion 184 of the drive hub 170. A patch 204 of material having a plurality of hook type fasteners is adhered to the lower surface of the scrub pad plate, for releasably retaining a scrub pad 206 to the plate. A plurality of substantially conical spikes 208, illustrated in FIGS. 11 and 12, extend down from the lower surface of the scrub pad plate 202 and partially penetrate the fibers of the scrub pad 206 for transferring torque from the scrub pad plate to the scrub pad. It will be appreciated that it is not critical that the spikes 208 be conical in shape. The spikes may be formed in any suitable shape that at least partially penetrates the fibers of the scrub pad for transferring torque to the scrub pad. An axially extending annular flange 210 on the scrub pad plate is concentrically received in an axially extending annular wall 212 extending down from the scrubber housing 164. The annular flange and the annular wall form a labyrinth seal for preventing lint, hair and other debris from entering the opening in the scrubber housing and fouling the drive hub.

Figure 13:
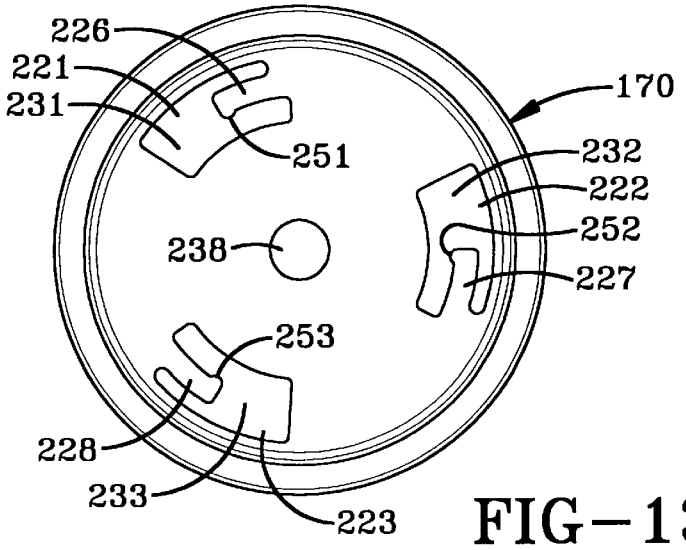
FIG. 13 is a bottom view of the scrub pad module drive hub.

Referring now to FIG. 13, generally C-shaped mounting slots 221, 222, 223 are formed in the drive hub 170. The C-shaped slots define resilient mounting arms 226, 227, 228 having nubs 251, 252, 253 on the ends thereof and open areas 231, 232, 233 adjacent the ends of the mounting arms. The scrub pad plate 202 is mounted to the drive hub 170 by first aligning a central aligning pin 236 extending up from the scrub pad plate, see FIGS. 10 and 12, with an opening 238 located in the center of the hub. The scrub pad plate 202 is then rotated until three radially outward facing mounting hooks 241, 242, 243 extending up from the scrub pad plate are aligned with open areas 231, 232, 233 in the C-shaped slots in the drive hub. The scrub pad plate is then moved axially toward the drive hub, such that the aligning pin and the mounting hooks on the pad plate are received in the corresponding openings in the hub. The scrub pad plate is then rotated clockwise relative the hub, as viewed from the bottom, whereby the mounting hooks cam past nubs 251, 252, 253 on mounting arms. The resilience of the mounting arms 226, 227, 228 causes the nubs to snap back once the hooks have been rotated past the nubs, whereby the hooks are non-rotatably captured between the nubs and the end walls of the C-shaped grooves. The scrub pad plate is removed from the drive hub by rotating the plate counter-clockwise relative the hub, until the hooks on the plate are received in the open spaces in the hub, and then pulling the scrub pad plate axially away from the hub.

Referring again to FIGS. 7 through 9, the scrub pad module 145 further includes a squeegee 260 formed of resilient material for wiping liquid from a hard surface. The squeegee is preferably formed of flexible PVC (polyvinylchloride), or other suitable elastomeric material. Two mounting tabs 262,264 with mounting holes 266,268 passing therethrough extend rearward from a top edge of the squeegee. The squeegee is secured to the scrub pad module 145 by passing the mounting tabs over mounting pins 270, 272 on the scrubber housing 164, such that the mounting pins are received in the holes in the mounting tabs, and then attaching the scrub pad module top plate 158 to the scrubber housing. When the top plate 158 is attached to the scrubber housing 164, the mounting tabs on the squeegee are trapped on the mounting pins, between the top plate and the scrubber housing. The top plate is secured to the scrub pad housing by passing mounting stakes 274 on the scrubber housing through corresponding holes 276 in the top plate 158, softening the tops of the stakes, and squashing the tops of the stakes to rivet the top plate to the housing, in the same manner as the top wall of the scrub brush module is attached to the brush housing.

As best illustrated in FIG. 7, when the scrub pad module 145 is attached to the extractor nozzle 1, the squeegee 260 extends forward across the inlet to the suction nozzle 12. In order to clean a hard surface, such as a counter top or bathtub, an operator attaches the pad module to the extractor nozzle and turns the extractor on. The extractor generates suction in the suction tube 18 for drawing air in through the turbine to drive the scrub pad. The suction in the suction tube draws the squeegee up against the suction nozzle inlet, such that the squeegee seals the nozzle inlet. As a result, the suction draws air in through the turbine only, in order to provide maximum power and torque for driving the scrub pad 206. The operator then presses the scrub pad against the surface to be cleaned and depresses the trigger 30 on the wand to spray cleaning liquid upon the surface. The surface is then scrubbed using the scrub pad, which is being rotationally driven by the turbine. After applying the desired quantity of cleaning liquid, the operator releases the trigger, ceasing the flow of cleaning liquid, and may continue to scrub the surface with the rotating scrub pad.

Figure 14:
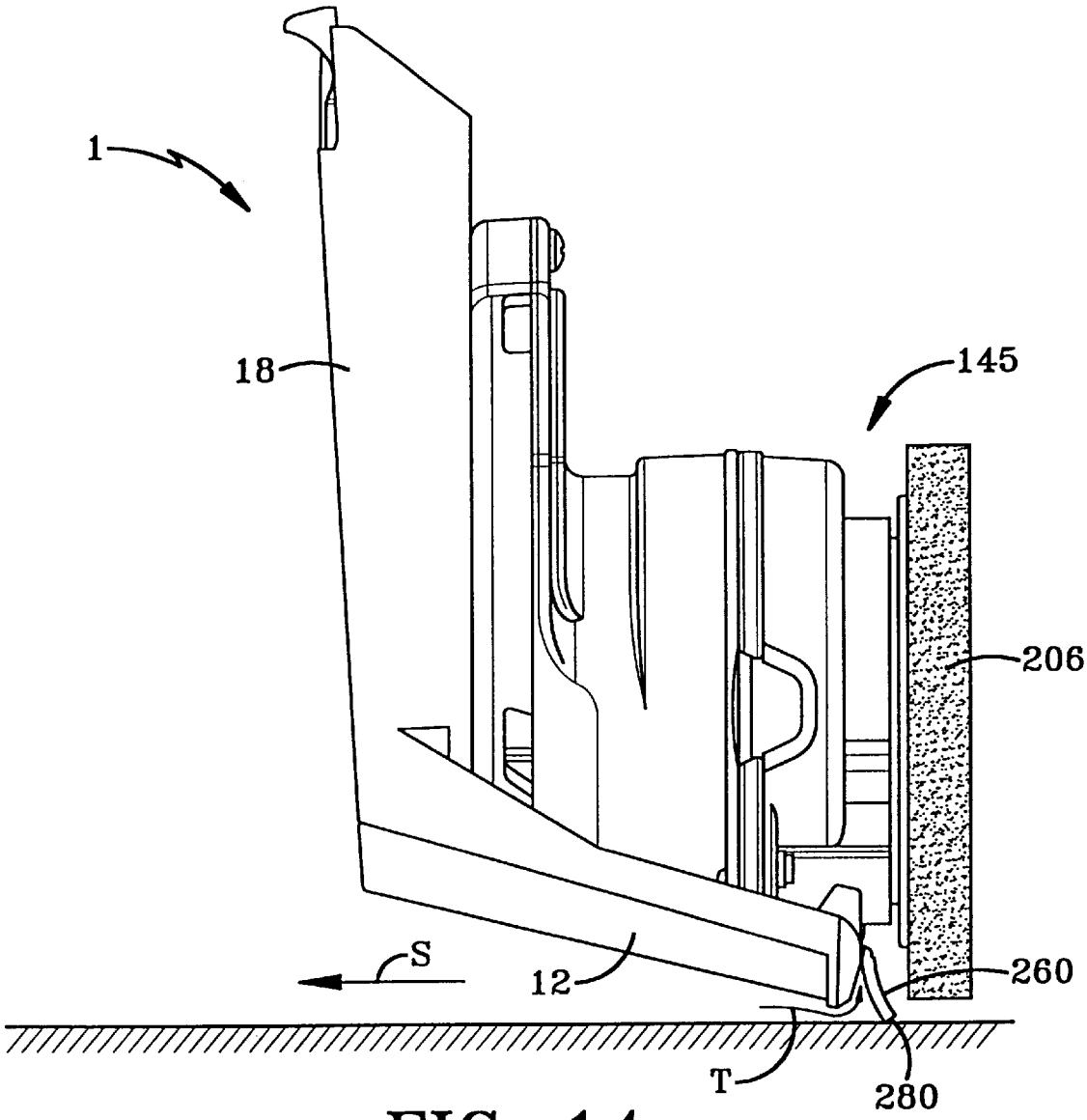
FIG. 14 is side view illustrating the suction nozzle being used to pickup liquid from a hard surface when the scrub pad module is attached to the nozzle.

The operator my remove soiled cleaning liquid from the surface being cleaned by pressing a wiping edge 280 of the squeegee 260 against the surface by turning the extractor nozzle 1 until the front of the nozzle 12 faces the surface being cleaned and pressing the squeegee against the surface as illustrated in FIG. 14. The operator then drags the squeegee along the surface by moving the extractor nozzle in the direction of arrow S in FIG. 14. Dragging the squeegee along the surface in the direction of arrow S causes the squeegee to yield and bend away from the nozzle inlet, whereby air is drawn into the nozzle inlet through the gap formed between the squeegee and the lips of the nozzle, as illustrated by arrow T. Soiled cleaning liquid is removed from the surface by the air being drawn into the nozzle.

The scrub modules 5 and 145 according to the present invention have been illustrated and described above using a preferred embodiment. It will be appreciated by one of skill in the art that the scrub module may include more than two scrub brushes. It will also be appreciated that the scrub pad may alternatively be integrally or non-removably formed with the scrub pad plate, or the scrub pad may be integrally or non-removably formed with the drive hub.

It will further be appreciated that turbine may be replaced with an electric motor or other suitable drive source. However, due to the intended wet environment in which the device is to be used, an air turbine is preferred. In addition, one of skill in the art will recognize that interchangeable scrub modules according the present invention may be used on a self-contained hand held extractor. In which case, the suction motor, supply tank and recovery tank would all be included in the hand held device itself, disposing of the need for a suction hose and a supply tube.

It can likewise be appreciated that the turbine powered extractor nozzle 1 described above may be connected directly to the end of a suction hose connected to an extractor or to a wet/dry utility vacuum cleaner. In which case, the second end of the suction tube 18 forms a hand grip by which the operator may hold the nozzle 1 when scrubbing and extracting with the nozzle 1. If desired, a separate spray device, such as a spray bottle, may be used to apply cleaning liquid to a surface to be cleaned prior to scrubbing and extracting with turbine powered extractor nozzle 1.

It will also be appreciated that the gear train may be any suitable gear train other than the gear reduction illustrated and described above. The gear train may, for example, be a planetary gear reduction arrangement.

Upon reading the above description it will become apparent to one of skill in the art that various modifications not discussed above may be made to the disclosed preferred embodiment of the invention, without departing from the scope of the present invention described by way of example above. As such, it is intended that the invention be limited not by the preceeding disclosure of a preferred embodiment, but only by the appended claims.

What is claimed is:

1. A cleaning tool comprising:

a drive source having an output shaft; and a plurality of interchangeable scrub drive modules, each scrub drive module having a plate, said plate comprising a scrubbing device housing having an opening defined therein and operatively connecting to a scrubbing device, said plate further comprising a through hole defined therein substantially corresponding with said scrubbing device housing opening said scrubbing device housing opening and said plate through hole capable of simultaneously receiving said output shaft, each scrub drive module being selectively attachable to said drive source and being operably connected thereto, each scrubbing device being driven by said output shaft when selectively attached thereto, said plurality of interchangeable scrub drives being a scrub brush module and a scrub pad module, said scrub brush module including at least two vertical axis scrub brushes, and having soft bristles suitable for scrubbing upholstery and carpet, said scrub pad module including a single vertical axis scrub pad and being suitable for cleaning hard surfaces, whereby only one of said interchangeable scrub drive modules is utilized during operation.

2. A cleaning tool according to claim 1, further comprising a wet extraction suction nozzle, having a suction inlet, mounted adjacent said drive source.

3. A cleaning tool according to claim 2, wherein said suction nozzle is located such that said suction inlet is adjacent to said scrub brushes when said scrub module is attached to said drive source, such that said scrub brushes and said suction inlet may be simultaneously pressed against a surface being cleaned.

4. A cleaning tool according to claim 2, wherein said scrub pad module includes a squeegee that extends across said suction inlet, such that a wiping edge of said squeegee is located immediately adjacent and parallel to said suction inlet.

5. A cleaning tool according to claim 4, wherein said drive source is an air powered turbine.

6. A cleaning tool according to claim 5, wherein said turbine includes at least one clean air inlet opening and an exhaust opening; and further comprising a suction tube fluidly communicating with said suction nozzle and with said exhaust opening of said turbine, whereby when suction is applied to said suction tube parallel air flows are created in through said suction nozzle and in through said turbine.

7. A cleaning tool according to claim 6, wherein, when suction is applied to said suction tube, said squeegee is drawn against said suction inlet, effectively sealing said suction inlet, whereby suction in said suction tube draws air in through said turbine only.

8. A cleaning tool according to claim 7, wherein said squeegee extends just beyond said suction nozzle, such that said wiping edge of said squeegee may be pressed against a surface being cleaned and, when dragged along the surface being cleaned, said squeegee yields, creating a gap between said squeegee and said suction inlet, whereby air is drawn in said suction inlet for removing liquid accumulated in front of the.

9. A cleaning tool according to claim 1, wherein said drive source is an electric motor.

10. A cleaning tool according to a claim 1, further including a cleaning applicator for applying cleaning liquid to a surface being cleaned.

11. A powered wet extraction cleaning tool comprising:

a wet extraction suction nozzle having a suction inlet opening and a nozzle outlet opening in fluid communication with a suction tube;

a scrub element for scrubbing a surface to be cleaned located adjacent to said suction nozzle;

an air powered turbine operatively connected to said scrub element for driving said scrub element, said turbine having at least one turbine inlet opening in communication with atmosphere and a turbine exhaust opening in communication with said suction tube; and a squeegee that extends across aid suction inlet opening, such that a wiping edge of said squeegee is located closely adjacent and parallel to said suction inlet opening thereby forming a gap between said inlet opening and said squeegee, whereby when suction is applied to said suction inlet opening, said squeegee is drawn against said suction inlet opening, substantially sealing said suction inlet opening, whereby suction in said suction tube draws air substantially in through said turbine only.

12. A cleaning tool according to claim 11, wherein said scrub element and said suction nozzle are arranged such that when said scrub element is pressed against a surface to be cleaned said suction nozzle and said squeegee are spaced from the surface to be cleaned.

13. A cleaning tool according to claim 12, wherein said scrub element, said nozzle and said squeegee are arranged whereby, when the wiping edge of said squeegee is pressed against a surface to be cleaned said scrub element is spaced from the surface to be cleaned; and wherein said squeegee extends just beyond said suction nozzle, such that when said wiping edge of said squeegee is pressed against the surface to be cleaned and dragged along the surface to be cleaned, said squeegee yields, creating said gap between said squeegee and said suction inlet opening, whereby air is drawn in said suction inlet for removing liquid accumulated in front of said squeegee.

14. A cleaning tool according to claim 11, wherein said squeegee extends just beyond said suction nozzle, such that said wiping edge of said squeegee may be pressed against a surface being cleaned and, when said squeegee is dragged along the surface being cleaned, said squeegee yields, creating said gap between said squeegee and said suction inlet, whereby air is drawn in said suction inlet for removing liquid accumulated in front of the squeegee.

15. A cleaning tool according to a claim 14, further including a cleaning applicator for applying cleaning liquid to a surface being cleaned.

16. A cleaning tool according to claim 11, wherein said scrub element is at least one scrub brush.

17. A cleaning tool according to claim, 11, wherein said scrub element is at least one scrub pad.

18. A cleaning tool according to a claim 11, further including a cleaning applicator for applying cleaning liquid to a surface being cleaned.

19. A powered wet extraction cleaning tool comprising:

a drive source having an output shaft, a plurality of selectively interchangeable scrubbing modules, the plurality of selectively interchangeable scrubbing modules being a first scrub brush module and a second scrub pad module, the first scrub brush module including at least two vertical axis scrub elements, said first scrub brush module being selectively attachable to said drive source with said scrub elements being operably connected to and driven by said output shaft, the second scrub pad module including a single vertical axis scrub member, said second scrub pad module being selectively attachable to said drive source, in place of said first scrub module, with said scrub member being operably connected to and driven by said output shaft, wherein only one of said interchangeable scrubbing modules is selectively attached to said drive source during operation.

20. A hand scrub tool comprising:

a drive source having an output shaft; and an interchangeable scrub drive module, said scrub drive module having a plate, said plate comprising a scrubbing device housing having an opening defined therein and operatively connecting to a scrubbing device, said plate further comprising a through hole defined therein substantially corresponding with said scrubbing device housing opening, said scrubbing device housing opening and said plate through hole capable of simultaneously receiving said output shaft, said scrub drive module being selectively attachable to said drive source and being operably connected thereto, said scrubbing device being driven by said output shaft when selectively attached thereto.

21. The hand scrub tool of claim 20, wherein said interchangeable scrub drive module is a scrub pad module.

22. The hand scrub tool of claim 21, wherein said scrub pad module comprises a single vertical axis scrub pad.

23. The hand scrub tool of claim 20, wherein said interchangeable scrub drive module is scrub brush module.

24. The hand scrub tool of claim 23, wherein said scrub brush module comprises at least two vertical axis scrub brushes, said two vertical axis scrub brushes operatively connected to said scrubbing device housing such that said two vertical axis scrub brushes intermesh when rotated by said drive shaft.

* * * * *